US008113488B2

(12) United States Patent
Stewart

(10) Patent No.: US 8,113,488 B2
(45) **Date of Patent: *Feb. 14, 2012**

(54) HAMMER AND HAMMER HEAD HAVING A FRONTAL EXTRACTOR

(76) Inventor: David W. Stewart, Briceville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/392,946

(22) Filed: Mar. 30, 2006

(65) Prior Publication Data

US 2006/0214145 A1 Sep. 28, 2006

Related U.S. Application Data

(63) Continuation-in-part of application No. 10/225,464, filed on Aug. 22, 2002, now Pat. No. 7,090,197.

(60) Provisional application No. 60/317,119, filed on Sep. 6, 2001.

(51) Int. Cl.
*B25D 1/04* (2006.01)
*B25C 11/00* (2006.01)

(52) U.S. Cl. ..... 254/26 R; 81/20; 81/24

(58) Field of Classification Search ..... 254/26 R, 254/26 E, 18, 19, 130, 131; 81/20, 23, 22, 81/24, 489; 7/143, 145; *B66F 15/00*
See application file for complete search history.

(56) References Cited

U.S. PATENT DOCUMENTS

| | | | | | |
|---|---|---|---|---|---|
| 99,470 | A | * | 2/1870 | Perham | 7/145 |
| 292,168 | A | * | 1/1884 | Lytle | 7/138 |
| 404,001 | A | * | 5/1889 | Heacock | 7/139 |
| 493,989 | A | * | 3/1893 | Duryea | 254/26 R |
| 506,465 | A | | 10/1893 | Blydenburgh | |
| 559,049 | A | | 4/1896 | Blydenburgh | |
| 592,278 | A | | 10/1897 | Clark | |
| 604,830 | A | * | 5/1898 | Karner | 7/145 |
| D30,786 | S | * | 5/1899 | Brownell | D8/79 |
| 673,772 | A | * | 5/1901 | Hall | 7/145 |
| D34,663 | S | * | 6/1901 | Yonge | D8/79 |
| 711,206 | A | | 10/1902 | Green | |
| 712,983 | A | * | 11/1902 | Voight | 81/20 |
| 724,542 | A | * | 4/1903 | Brownell | 254/26 R |
| 736,797 | A | | 8/1903 | Steele | |
| 822,943 | A | * | 6/1906 | Gorsuch | 254/25 |
| 835,961 | A | * | 11/1906 | Lee | 254/26 R |
| 899,287 | A | * | 9/1908 | Blakely | 7/143 |
| 1,041,903 | A | * | 10/1912 | Thomas | 81/23 |
| 1,042,177 | A | | 10/1912 | Vredenburg | |
| 1,105,946 | A | * | 8/1914 | Wodtli | 254/26 R |

(Continued)

OTHER PUBLICATIONS

David W. Stewart, "Hammer Head", design application U.S. Appl. No. 29/232,010, filed Jun. 14, 2005.

*Primary Examiner* — Lee D Wilson
*Assistant Examiner* — Jamal Dainel
(74) *Attorney, Agent, or Firm* — Studebaker & Brackett PC; Donald R. Studebaker

(57) ABSTRACT

A hammer that includes a handle with a first end, a hammer head secured to the first end of the handle, the hammer head having a striking head at one end, the striking head having a striking surface thereon, a first frontal extractor extending from the striking head, and a second frontal extractor disposed between the handle and the striking head. In one embodiment, the hammer includes a slot positioned between the first and second frontal extractors, and the webbing being integrally formed with the frontal extractors to connect the frontal extractors together.

38 Claims, 12 Drawing Sheets

U.S. PATENT DOCUMENTS 1,182,348 A * 5/1916 Charley ..... 254/26 R
1,252,903 A * 1/1918 Hight ..... 254/26 R
1,286,335 A * 12/1918 Johnson ..... 254/26 R
1,287,619 A 12/1918 Benjamin
1,340,401 A * 5/1920 Olney ..... 254/26 R
1,425,369 A * 8/1922 Coleman ..... 254/26 R
1,534,277 A 4/1925 Loven
1,535,685 A * 4/1925 Randell et al. ..... 254/26 R
1,600,275 A * 9/1926 Darr et al. ..... 254/26 R
1,656,652 A 1/1928 Thorson
1,660,237 A 2/1928 Small
1,792,437 A 2/1931 Metzger et al.
1,934,680 A 11/1933 Bosco
1,959,380 A 5/1934 Moses
2,239,719 A * 4/1941 Jarrett ..... 254/26 R
2,491,129 A * 12/1949 Nieuwsma ..... 254/26 R
2,589,046 A 3/1952 Brown et al.
2,657,903 A 11/1953 Johnson
2,674,794 A * 4/1954 Baker ..... 30/171
2,890,018 A * 6/1959 Johnson ..... 254/26 R
3,150,858 A * 9/1964 David ..... 254/26 R
D235,243 S 6/1975 Pecenka
3,963,215 A * 6/1976 Connor ..... 254/26 R
4,216,808 A 8/1980 Royce
D269,061 S 5/1983 Peterson
4,422,620 A 12/1983 Nitzberg
4,482,132 A * 11/1984 Lamansky ..... 254/26 R
4,533,116 A 8/1985 Panovic
D288,406 S 2/1987 Santos
4,998,996 A 3/1991 Belanger
5,060,911 A 10/1991 Mikesell
D327,406 S 6/1992 Kittelson
5,159,858 A * 11/1992 Gansen ..... 81/23
5,249,776 A 10/1993 Johnson
5,280,737 A 1/1994 Floyd
D353,758 S 12/1994 Frykman
5,441,236 A 8/1995 Kiernan
5,595,369 A 1/1997 Hull
D381,250 S * 7/1997 Williams ..... D8/75
5,674,002 A * 10/1997 Powell et al. ..... 703/1
D411,427 S 6/1999 Nakayama
D413,781 S 9/1999 Wong
6,032,927 A 3/2000 Atkinson
6,095,497 A 8/2000 Chen
D438,082 S 2/2001 Stegner et al.
6,192,539 B1 * 2/2001 Fraga et al. ..... 7/144
6,279,876 B1 8/2001 Massie
6,339,858 B1 * 1/2002 Fraga et al. ..... 7/144
6,598,858 B2 * 7/2003 Santa Cruz et al. ..... 254/26 R
D502,076 S * 2/2005 Stewart ..... D8/79
D502,855 S * 3/2005 Stewart ..... D8/79
6,866,247 B2 * 3/2005 Thompson ..... 254/26 R
7,090,197 B2 * 8/2006 Stewart ..... 254/26 R
D534,050 S * 12/2006 Stewart ..... D8/79
2003/0052313 A1 * 3/2003 Santa Cruz et al. ..... 254/26 R
2003/0057407 A1 * 3/2003 Stewart ..... 254/26 R
2004/0244545 A1 * 12/2004 Stinnissen et al. ..... 81/489
2006/0208242 A1 * 9/2006 Stewart ..... 254/26 R
2006/0214145 A1 * 9/2006 Stewart ..... 254/26 R
2007/0006686 A1 * 1/2007 Warren et al. ..... 81/20
2010/0038609 A1 * 2/2010 Chen ..... 254/26 R
2010/0116096 A1 * 5/2010 Hanlon ..... 81/22

* cited by examiner

HAMMER AND HAMMER HEAD HAVING A FRONTAL EXTRACTOR

This application is a continuation-in-part of application Ser. No. 10/225,464, filed Aug. 22, 2002, which claims priority to U.S. Provisional Application No. 60/317,119, filed Sep. 6, 2001.

BACKGROUND OF THE INVENTION

1. Field of the Invention

The present invention is directed to hammers and hammer heads that may be used to extract nails or other fasteners. In particular, the present invention is directed to a hammer or hammer head having a frontal extractor.

2. Description of Related Art

Most conventional hammers are of either the straight rip-claw type or the curved-claw type. Both types are used for nail extraction. These claw hammers have a striking head or poll on the front of the hammer head, and a nail-removing claw located at the back of the hammer head opposite the striking head. Claw hammers are used for various household purposes and in the construction industry, such as for framing and finishing work, as well as for ripping and other demolition work. Of course, these uses are merely identified for example purposes; hammers may be used in other applications for various other purposes.

One significant limitation of conventional claw hammers is that they cannot be used to extract nails easily or quickly. This is largely due to the fact that once the nail is extracted a distance of about one inch, leverage is substantially reduced. In particular, as the nail is extracted using the conventional claw hammer, the fulcrum point moves away from the nail, thereby effectively decreasing the leverage and effectively increasing the required force that must be exerted by the user of the hammer to further extract the nail. This disadvantage or limitation of the conventional claw hammer is especially problematic when the nails are designed to be difficult to extract. For instance, large nails, glue-coated nails, or nails having ribbed shanks may be very difficult to extract and may therefore require exertion of substantial force by the user to do so.

Other limitations of the conventional claw hammer relate to the extraction of relatively long nails, or nails that have already been partially removed from a surface. Due to the geometry of the conventional claw in relation to the striking portion of the hammer head, complete extraction is often impeded. In addition, if the nail to be extracted is especially long, extraction using a conventional claw may also severely bend the nail so that complete extraction is further impeded. To extract such long nails, it is often necessary for a carpenter to use a special nail-pulling tool in addition to the hammer, or to find a block of wood or other object to place underneath the head of the hammer to raise the hammer so as to reestablish the fulcrum point above the surface for greater leverage.

Various solutions have been proposed to try to overcome the above described limitations of conventional claw hammers. In particular, U.S. Pat. Nos. 6,279,876, 5,441,236, 5,249,776, 5,060,911, 4,998,996, 4,533,116, 4,422,620, 2,657,903, and 2,589,046 all disclose claw hammers in which the positioning of the fulcrum is enhanced or otherwise made adjustable to provide adequate leverage to facilitate nail extraction, especially of long nails. In this regard, these proposed hammers provide a movable mechanism that extends outwardly from the top of the hammer that provides an elevated fulcrum point to allow the extraction of long nails. The proposed solutions, however, utilize various moving parts that increase the cost and decrease the durability of the hammers. In addition, in many proposed implementations, the hammers must be manually adjusted to provide for the extended fulcrum, which makes the use of the hammers with such features cumbersome, inconvenient, and time-consuming. A moveable, extensible fulcrum also decreases the stability of the hammers, and along with the wear and breakage of the fulcrum mechanism inevitably occasioned by the conventional striking and ripping uses of the hammers, creates a substantial risk of injury to the user.

Other solutions have also been proposed to try to overcome the above limitations of conventional claw hammers. For instance, U.S. Pat. Nos. 2,239,719, 1,535,685, 1,425,369, and 559,049 all disclose hammers having multiple claws to allow engagement and extraction of long nails and nails that extend from a surface at various lengths. Such proposed claw hammers, however, still fail to address the leverage limitation caused by the movement of the fulcrum away from the nail. The various proposed solutions fail to solve the inefficiencies associated with extraction by conventional means, and in turn create separate problems that engender either additional inefficiencies, such as breakage, instability, time waste, exhaustion, and potential injury, or various interferences with the full functioning of the conventional claw hammer.

Still another limitation of the conventional claw hammer is that due to the positioning of the claw on the hammer head, the user must reverse his grip and/or turn the hammer around to use the claw. This impedes work efficiency in situations where nails must be driven and extracted quickly on a continuous basis. For instance, weaker nails such as aluminum, brass, or galvanized nails tend to bend when being driven into harder woods or surfaces. Of course, these bent nails must be removed so that a replacement nail may be inserted instead. Each extraction and insertion of another replacement nail would entail reversing the rip and/or turning the claw hammer around twice. U.S. Pat. No. 1,252,903 discloses a lathing hatchet having a claw positioned below a hammer poll on the same side of the hatchet. The lathing hatchet of the '903 reference cannot be used like a conventional hammer, however, because a claw is not provided opposite to the hammer poll. Moreover, the claw of the disclosed lathing hatchet fails to provide sufficient leverage to accomplish efficient or complete extraction of most nails. In particular, long nails and nails that extend from a surface at various lengths cannot be easily extracted using the disclosed lathing hatchet. Furthermore, to extract most nails, the disclosed lathing hatchet requires substantial repositioning in order to engage nails with means separate from the claw, and also anticipates the use of additional means, such as a block of wood, in order to complete extraction. In this regard, the disclosed lathing hatchet admits of inefficiencies similar to those inherent in the proposed solutions to the problems associated with using the conventional claw hammer as a nail extractor.

Lastly, U.S. Pat. No. D438,082 discloses an ornamental design for a hammer with a provision for holding a nail in place so that the nail may be initially driven into a surface without the user having to hold the nail with the other hand. The nail appears to be held in place by a set screw that engages the shank of the nail. The use of this holding feature is cumbersome, however, because it requires tightening and loosening of the set screw each time the user desires to use the holding feature.

Therefore, in view of the above, an unfulfilled need still exists for an improved hammer that avoids the above described limitations of the conventional and prior art hammers. In particular, an unfulfilled need still exists for an improved hammer that facilitates the extraction of nails, that permits the full functioning of the hammer as a hammer, and that provides additional functionality and features enhancing the utility of the hammer.

SUMMARY OF THE INVENTION

In view of the above, one advantage of the present invention is in providing a hammer that facilitates extraction of nails from surfaces.

Another advantage of the present invention is in providing a hammer that maintains the fulcrum point of the hammer substantially constant so that effort required to extract the nail is not increased as the nail is extracted.

Still another advantage of the present invention is in providing a hammer that allows extraction of nails without reversing grip or turning the hammer around.

Yet another advantage of the present invention is in providing a hammer that facilitates extraction of long nails.

A further advantage of the present invention is in providing a hammer that facilitates proper positioning of commonly sized wood beams by facilitating twisting thereof.

Still another advantage of the present invention is in providing a hammer that facilitates the initial driving of a nail into a surface.

Yet another advantage of the present invention is in providing a hammer that increases efficiency of nail extraction and that provides enhanced utility, while also permitting the hammer to be used in the conventional manner.

These and other advantages and features are attained by a hammer that includes a handle with a first end, a hammer head secured to the first end of the handle, the hammer head having a striking head at one end, the striking head having a striking surface thereon, a first frontal extractor extending from the striking head, and a second frontal extractor disposed between the handle and the striking head.

In accordance with one embodiment, the first frontal extractor extends from the striking head at a distal end thereof adjacent to the striking surface. Preferably, the second frontal extractor is shorter in length than the first frontal extractor. The hammer may include a groove that extends through the first and second frontal extractors, and at least one slot positioned between the first and second frontal extractors. The slot is sized to allow a head of a nail to be supported therein so that the nail is cantilevered substantially perpendicular relative to the striking surface. In one example implementation, the slot may be dimensioned approximately between 1/16 to 1/8 inch in width, for example, approximately 3/32 inch in width.

In accordance with another embodiment of the present invention, the slot of the hammer is bounded by webbing at ends thereof. Preferably, the webbing is integrally formed with the first and second frontal extractors, and connects the frontal extractors together.

In accordance with another embodiment, the first frontal extractor extends from the striking head substantially parallel to the handle, and is spaced approximately 1 5/8 inches from the handle. In another embodiment, the second frontal extractor extends substantially parallel to the handle, and is spaced approximately 1 1/4 inches from the handle.

In other embodiments of the hammer, the first frontal extractor and/or the second frontal extractor may be magnetized to allow a nail to be supported therein so that the nail is cantilevered substantially perpendicular relative to the striking surface. In addition, the first frontal extractor may include tips at a distal end thereof that are angled to facilitate engagement with the nail to be extracted. In this regard, the tips may be angled with a curvature.

In accordance with another aspect of the present invention, a hammer head is also provided having various features noted.

These and other advantages and features of the present invention will become more apparent from the following detailed description of the preferred embodiments of the present invention when viewed in conjunction with the accompanying drawings.

DESCRIPTION OF THE PREFERRED EMBODIMENTS

As will be evident to one of ordinary skill in the art, a hammer and a hammer head in accordance with the present invention overcome the previously noted disadvantages of the prior art hammers. In particular, the present invention facilitates extraction of nails, and enhances the user's reach so that nails in elevated locations may be extracted. In addition, the hammer and the hammer head in accordance with one embodiment of the present invention also facilitate insertion of a nail and facilitate rotation of a beam. In this regard, whereas the various figures discussed below show a complete hammer that includes a handle integrally formed with the hammer head, it should be apparent that the present invention also encompasses a hammer head that may readily be attached to a separate handle to thereby form a hammer. Therefore, the various features of the present invention as described herein below are applicable to both hammers as well as hammer heads.

Figure 1:
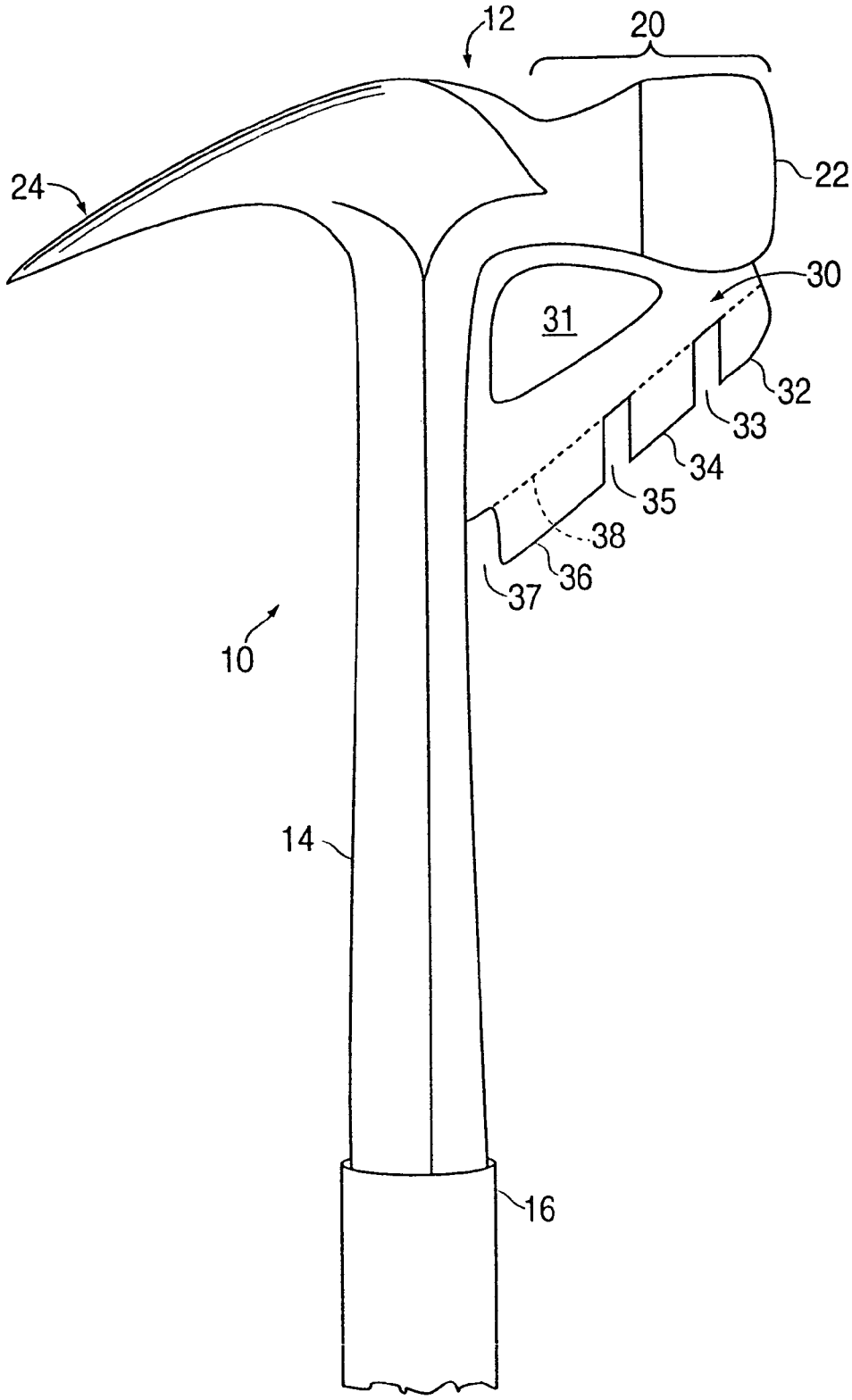
FIG. 1 is a partial side profile view of a hammer in accordance with one embodiment of the present invention.

FIG. 1 is a partial side profile view of a hammer 10 in accordance with one embodiment of the present invention. It should be noted that although the hammer 10 shown in the present embodiment as well as other embodiments below are of the claw type commonly used by carpenters, homeowners, etc., the present invention is not limited thereto and may be embodied in other types of hammers as well.

Referring again to FIG. 1, hammer 10 in the illustrated embodiment includes a head 12 that is attached to a first end of handle 14. The handle 14 of the hammer 10 is provided with handle grip 16 (only partially shown) to facilitate handling of the hammer 10 by the user. The head 12 of the hammer 10 includes a striking head 20 that extends substantially perpendicularly to the handle 14. The striking head 20 includes a striking surface 22 at one end thereof for driving nails, fasteners, etc. The head 12 of the hammer 10 also includes a conventional claw 24 with a v-shaped groove for engaging the head of a nail and extracting the nail. The provision of the claw 24 allows the illustrated hammer 10 to be used in a substantially conventional manner.

The hammer 10 in accordance with the illustrated embodiment is also provided with an interface section 30 that diagonally spans between the underside of the striking head 20 and the front side of the handle 14 of the hammer 10. In the illustrated embodiment, the diagonal orientation of the interface 30 results in webbing 31 between the interface section 30 and the hammer head 12 and the handle 14 as shown. The interface section 30 is provided with first, second, and third frontal extractors 32, 34, and 36, respectively. In this regard, the frontal extractors 32, 34, and 36 are formed on the interface section 30 by cavities or slots 33, 35, and 37, respectively.

The slots 33, 35, and 37 formed on the interface section 30 are preferably sized to allow the heads of nails or other fasteners to be engaged by the frontal extractors 32, 34, and 36 for the purpose of extraction. In this regard, surface 38 (indicated by dashed line) in the interface section 30 defines a contact surface of a groove for restricting movement of the nail or other fastener as it is extracted. In addition, the frontal extractors 32, 34, and 36 are sequentially positioned along the interface section 30 to facilitate extraction of nails or other fasteners that protrude from a surface, such as a wall or a beam, at different lengths. In addition, the sequential positioning of the frontal extractors 32, 34, and 36 allows progressive leveraging to facilitate extraction of long nails or other fasteners.

Figure 2:
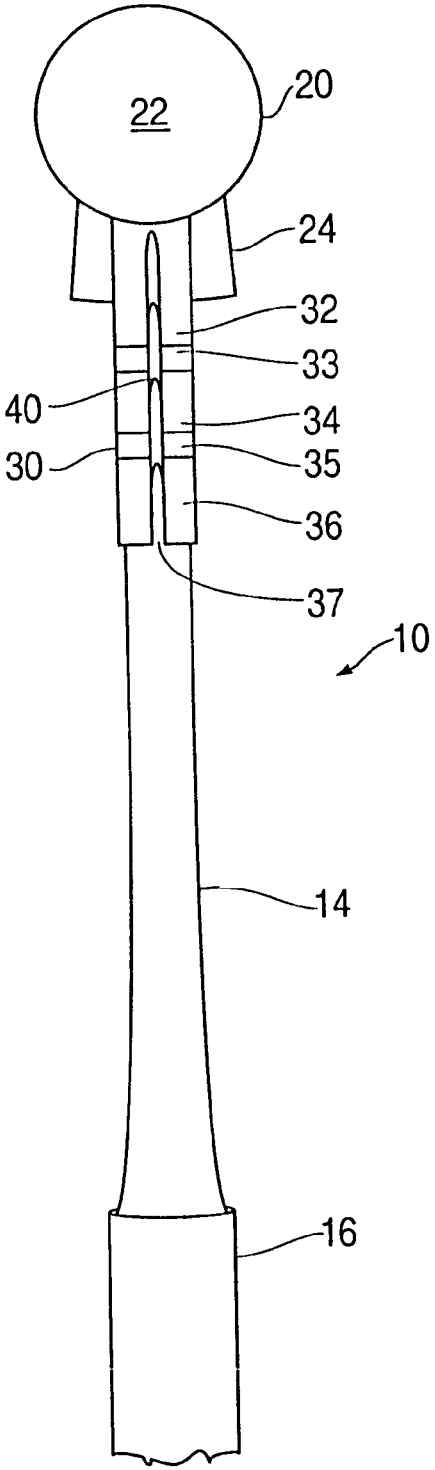
FIG. 2 is a frontal view of the hammer of FIG. 1.

FIG. 2 shows a frontal view of the hammer 10 of FIG. 1, both of these figures being referred to herein for clarity. As shown, the interface section 30 is preferably not wider than the striking head 20 of the hammer 10 so that the interface section 30 does not interfere with the full function of the hammer 10 as a standard claw hammer. However, in other embodiments and applications, the interface section 30 of the present invention and the frontal extractors provided thereon may be slightly wider than the striking head 20. A groove 40 with surface 38 extends through the frontal extractors 32, 34, and 36 as shown, the v-shaped surfaces indicating the interface between the groove 40 and the frontal extractors 32, 34, and 36.

Figure 3:
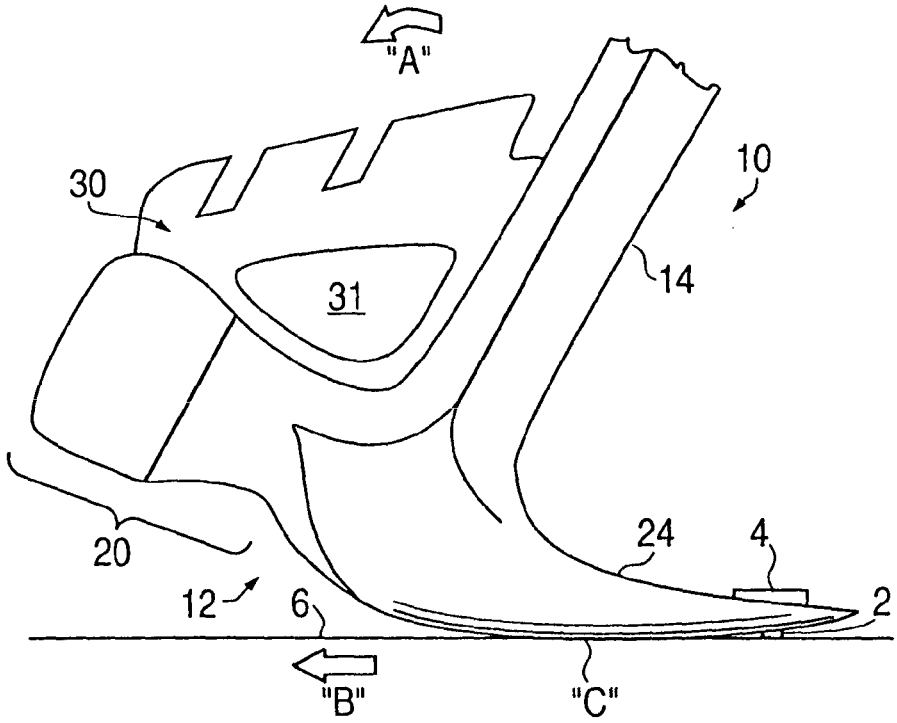
FIG. 3 is a partial side profile view of the hammer of FIG. 1 being used to extract a nail using the conventional claw provided thereon.

FIG. 3 shows the hammer 10 of the present embodiment being used to extract nail 2 from surface 6, which may be a wall, a beam or any other surface using the conventional claw 24. By rotating the hammer 10 in the direction of arrow "A", the nail 2 may be extracted. In the illustration, however, when the nail 2 is extracted using the conventional claw 24, the fulcrum point "C" of the hammer 10 moves in the direction of arrow "B" away from the nail 2 as the hammer 10 is rotated in the direction of arrow A. As previously described, this movement of the fulcrum point C away from the nail 2 increases the length of the effective lever arm between the fulcrum point C and the nail 2 thereby increasing the force required to rotate the hammer 10 in the direction of arrow A.

Figure 4:
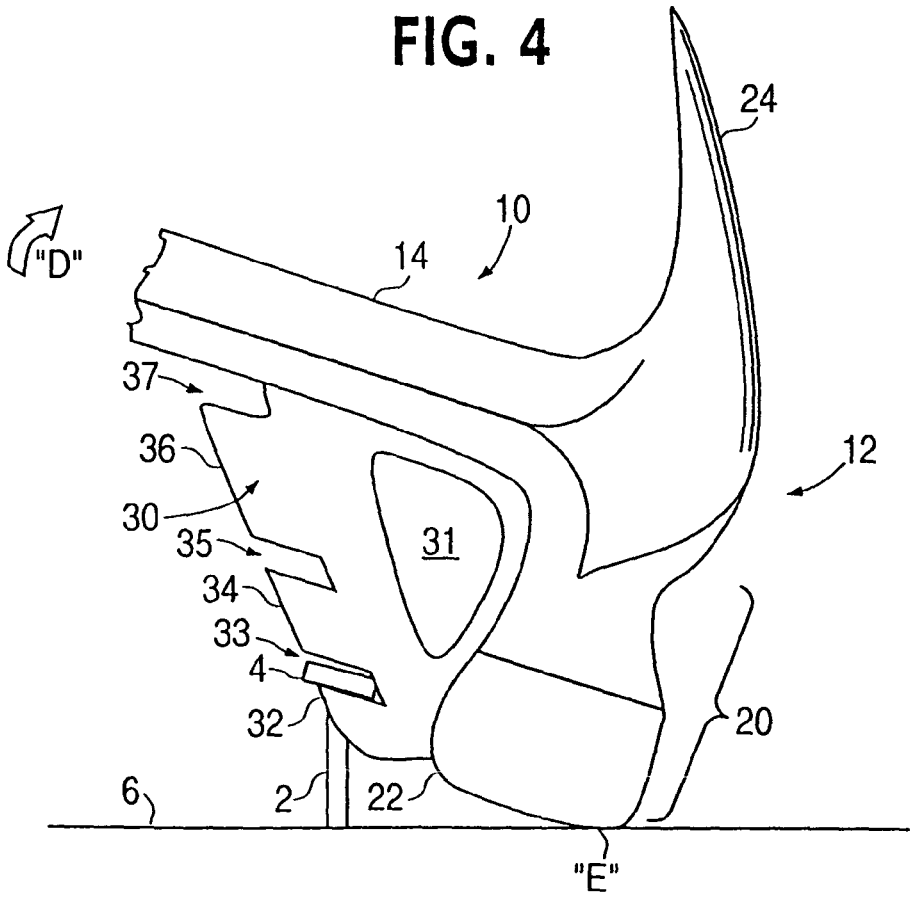
FIG. 4 is a partial side profile view of the hammer of FIG. 1 being used to extract a nail using the frontal extractor provided thereon.

FIG. 4 shows the hammer 10 of the present embodiment being used to extract nail 2 from surface 6 using the first frontal extractor 32 that is provided on the interface section 30 of the hammer 10. In this regard, the hammer 10 is positioned so that the striking surface 22 of the striking head 20 is positioned along surface 6. The hammer 10 is then maneuvered so that frontal extractor 32 engages the head 4 of the nail 2. The hammer 10 is rotated in the direction of arrow "D" so that the hammer 10 pivots about the fulcrum point "E" thereby extracting the nail 2 by pulling it by its head 4.

In contrast to nail extraction using the conventional claw 24 as described above with respect to FIG. 3, the fulcrum point E shown in FIG. 4 remains substantially stationary relative to the position of the nail 2. Thus, the length of the effective lever arm between the fulcrum point E and the nail 2 remains constant. Consequently, the force required to rotate the hammer 10 in the direction of arrow D does not increase as it does in using the conventional claw 24, and therefore the effort and force required by the user of the hammer 10 to remove nails and other fasteners is greatly reduced. If the nail 2 is long, the fulcrum point E actually moves slightly closer to the nail 2, thereby further reducing the force required to rotate the hammer 10 as the nail 2 is extracted.

This reduction in effort greatly enhances the utility of the hammer 10 in accordance with the present invention by minimizing fatigue for end users such as carpenters and framers who must extract many dozens of nails and other fasteners on a daily basis. In addition, the hammer 10 of the present invention further allows extraction of nails that could otherwise not be removed using conventional claw extractors.

In addition, extraction of long nails or fasteners is also facilitated by the sequential positioning of the frontal extractors 32, 34, and 36 on the interface section 30 of the hammer 10. In particular, in cases where the nail 2 is especially long or protrudes far from the surface 6, proper positioning and leveraging of the hammer 10 may not be easily attained when the head 4 of the nail 2 is engaged in the first frontal extractor 32. In such an instance, the second frontal extractor 34, which is positioned along the interface section 30 to receive longer protruding nails, may be used. In the illustrated embodiment, the interface section 30 is further provided with a third frontal extractor 36 to receive even longer protruding nails.

Moreover, the sequential positioning of the frontal extractors 32, 34, and 36 on the interface section 30 facilitates extraction of long nails by allowing the user to partially extract the nail 2 from the surface 6 by using the first frontal extractor 32, and then, by using the second frontal extractor 34 and/or the third frontal extractor 36 to fully extract the remaining portion of nail 2. This eliminates the need for bolstering the position of the hammer head 12 by using a wooden block as is conventionally done in the field by carpenters, or the need for a complex mechanism as attempted in the prior art.

In this regard, the above discussed embodiment of the present invention provides a novel method of extracting nails or other fasteners from a surface. In particular, referring to FIGS. 1, 2, and 4, the method disclosed includes the steps of positioning the hammer 10 adjacent to the nail 2 in a manner that the striking surface 22 of the hammer 10 that defines a front of the hammer 10, contacts the surface 6 from which the nail 2 is to be extracted. The nail 2 is engaged using the first frontal extractor 32 that is positioned toward the front of the hammer 10 proximate to the striking surface 22. The handle 14 is then rotated in the direction of arrow D about the striking surface 22 as shown in FIG. 4 to partially extract the nail from the surface.

Then, the nail 2 is disengaged from the first frontal extractor 32 and engaged by the second frontal extractor 34 that is positioned toward the front of the hammer 10 between the first frontal extractor 32 and the handle 14. The handle 14 is again rotated about the striking surface 22 to further extract the nail 2 from the surface. Depending on the length of the nail 2, the above steps may be sufficient to fully extract the nail 2 from the surface 6. However, to the extent that the above steps do not fully extract the nail, the nail 2 is disengaged from the second frontal extractor 34 and engaged by the third frontal extractor 36 that is positioned toward the front of the hammer 10 between the second frontal extractor 34 and the handle 14. The handle 14 is again rotated about the striking surface 22 to fully extract the nail 2 from the surface 6.

Figure 5:
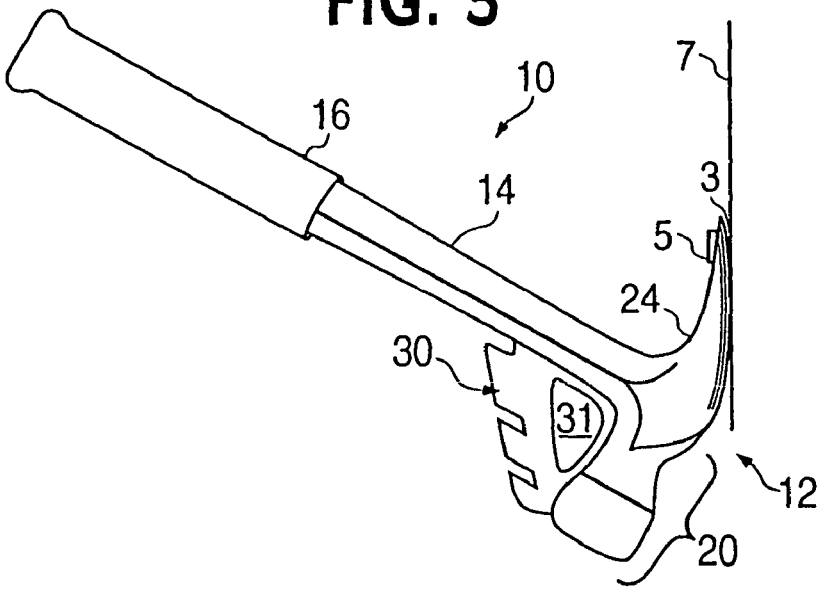
FIG. 5 is a side profile view of the hammer of FIG. 1 being used to extract a nail on a vertical surface using the conventional claw.
Figure 6:
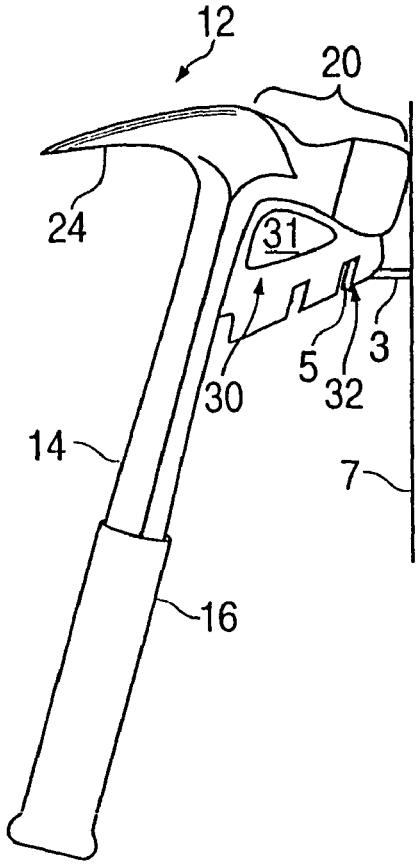
FIG. 6 is a side profile view of the hammer of FIG. 1 being used to extract a nail on a vertical surface using the frontal extractor of the hammer in accordance with one embodiment of the present invention.

Further benefits of utilizing the hammer 10 in accordance with the present invention are also shown in FIGS. 5 and 6 that illustrate the hammer 10 being used to extract a nail 3 from a vertical surface 7 using the conventional claw 24 and a frontal extractor 32, respectively. If the nail 3 is embedded in a vertical surface 7, the ability of the conventional claw 24 to remove the nail 3 may be significantly diminished if the nail 3 and its head 5 is at a height just out of reach of the user. In particular, as shown in FIG. 5, in order to extract the nail 3 using the conventional claw 24 of the hammer 10, the handle grip 16 of the hammer 10 must actually be elevated higher than the height of the nail 3 itself. Thus, if the head 5 of nail 3 is positioned just out of reach of the user, it cannot be easily extracted unless a ladder or other elevating device is used to increase the reach of the user.

In contrast, as clearly shown in FIG. 6, the frontal extractors 32, 34, and 36 position the handle grip 16 of the hammer 10 at a significantly lower height position relative to the nail 3. This effectively increases the reach of the user so that head 5 of nail 3 may be engaged. In this manner, the present invention allows extraction of nails or other fasteners using the frontal extractors 32, 34, and 36 that would otherwise be out of reach.

The hammer 10 may be manufactured in any conventional manner using steel and/or other appropriate materials. In this regard, interface section 30 with the frontal extractors provided thereon, may be integrally formed with the hammer head 12 and/or the handle 14. Alternatively, the interface section 30 may be manufactured separately from the hammer 10, and subsequently attached to the hammer head 12 and/or the handle 14 by welding or by any other appropriate manner to provide secure attachment thereof. In this regard, the interface section and the frontal extractors in accordance with the present invention may be implemented as a separate component that may be retrofitted to existing conventional hammers. For instance, the interface section and the frontal extractors mechanically secured using mechanisms such as clamps and/or fasteners including bolts, screws, pins, etc. In addition, although in the illustrated embodiment the interface section 30 is attached to the hammer head 12 and the handle 14 of the hammer 10, the interface section 30 may be cantilevered in other embodiments.

Figure 7:
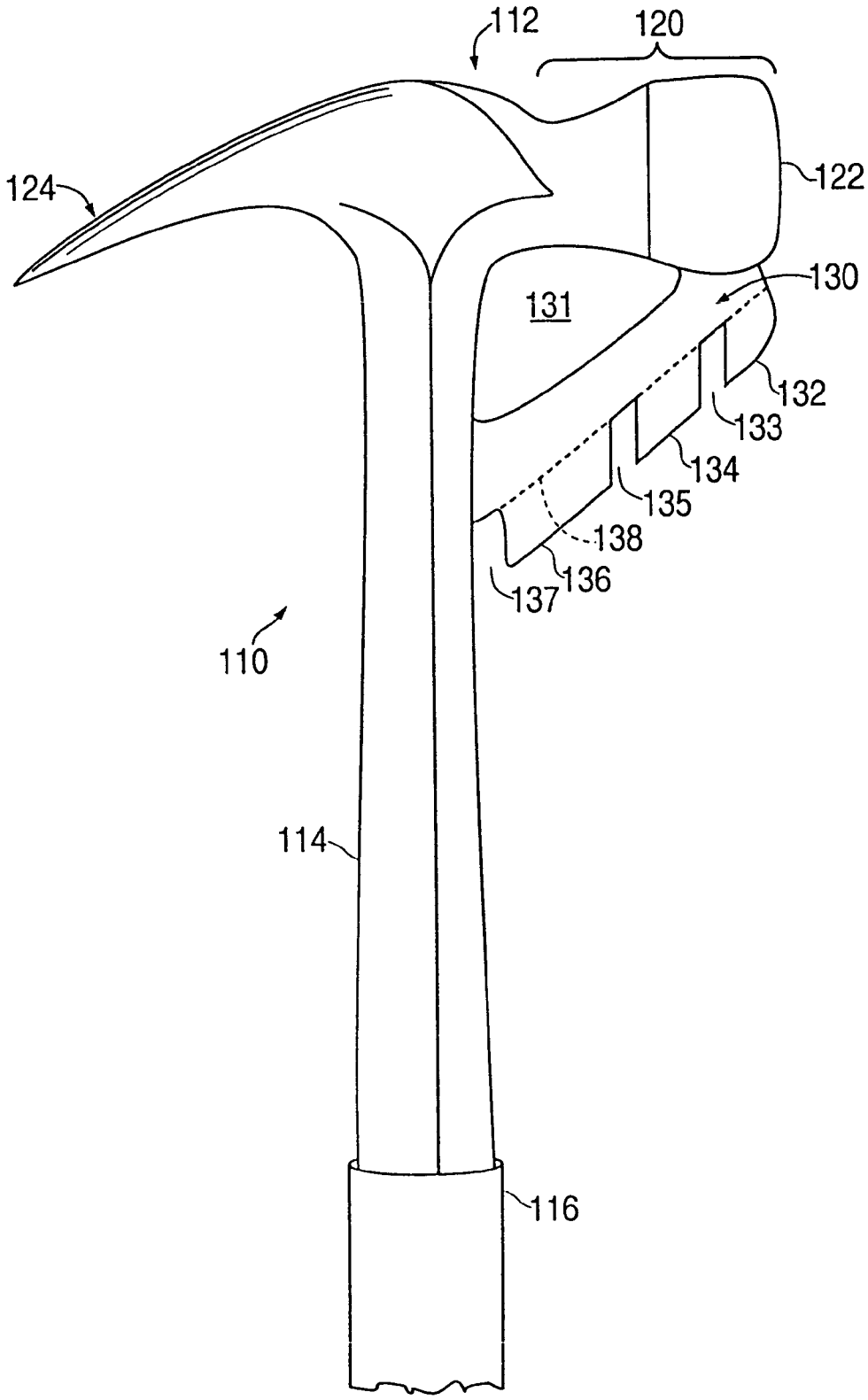
FIG. 7 is a partial side profile view of a hammer in accordance with another embodiment of the present invention.

FIG. 7 is a partial side profile view of a hammer 110 in accordance with another embodiment of the present invention. As shown, the hammer 110 is substantially similar to hammer 10 of FIG. 1 discussed above. In this regard, the hammer 110 includes a head 112 that is attached to a first end of handle 114, the handle 114 being provided with handle grip 116 (only partially shown). The head 112 of the hammer 110 includes a striking head 120 extending perpendicularly from the handle 114, and a conventional claw 124, the striking head 120 having a striking surface 122.

The hammer 110 in accordance with the illustrated embodiment also includes an interface section 130 that diagonally spans between the underside of the striking head 120 and the front side of the handle 114 of the hammer 110. In this regard, in the illustrated embodiment, the diagonal orientation of the interface section 130 results in an opening 131 being formed between the interface section 130 and the hammer head 112 as shown. The opening 131 serves to conserve manufacturing material and to permit adaptation to weight and balance considerations.

Like the previously described embodiment, interface section 130 is provided with first, second, and third frontal extractors 132, 134, and 136, respectively. In this regard, the frontal extractors 132, 134, and 136 are formed on the interface section 130 by slots 133, 135, and 137, respectively, that are sized to allow the heads of nails or other fasteners to be engaged. As previously described, surface 138 (indicated by dashed line) in the interface section 130 defines a contact surface of a groove that extends through the slots 133, 135, and 137 for restricting movement of the nail or other fastener as it is extracted. The hammer 110 may be utilized in substantially the same manner as hammer 10 described previously with respect to FIGS. 3 to 6. Consequently, further discussion of hammer 110 and its operation is omitted to avoid repetition.

Figure 8:
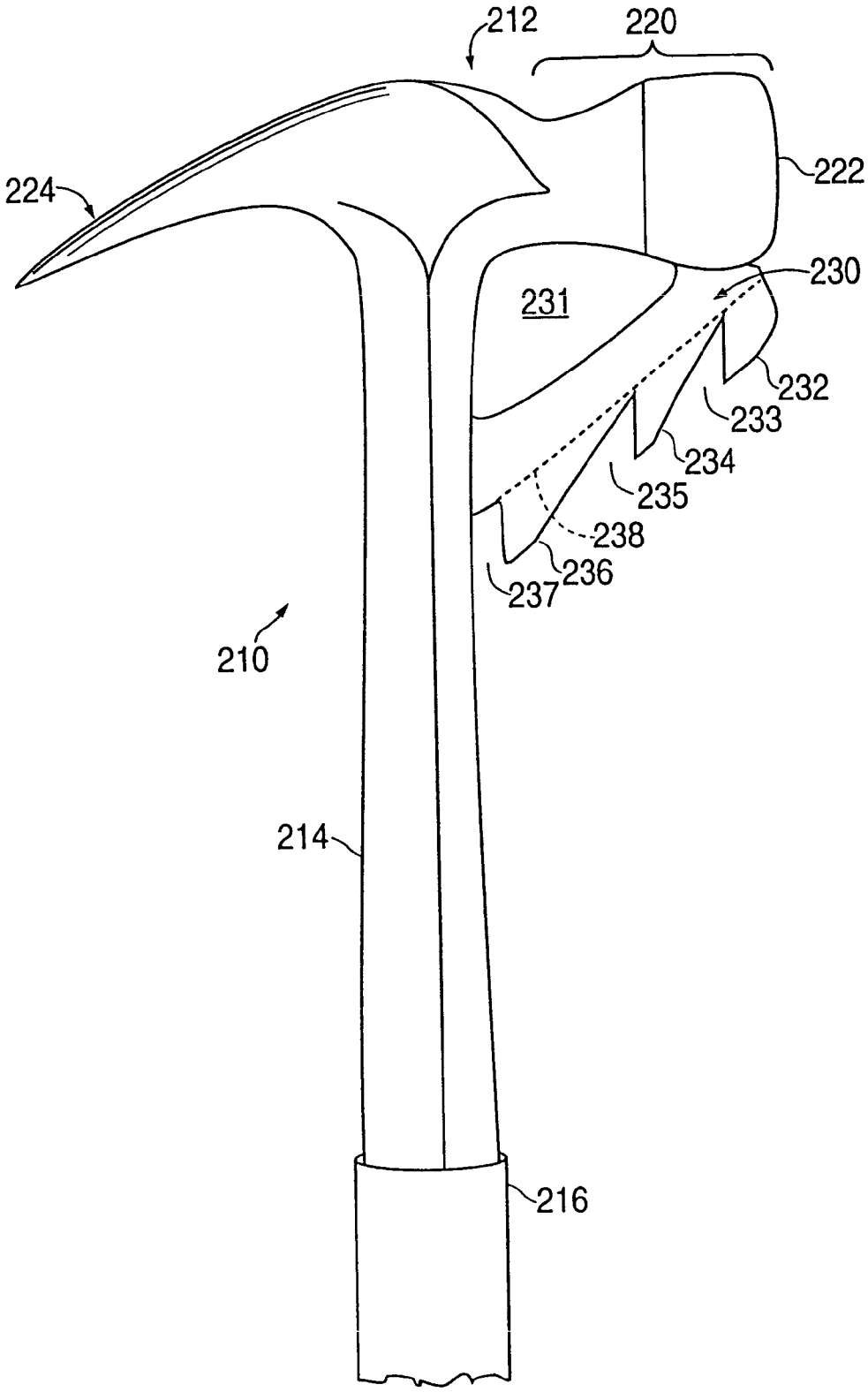
FIG. 8 is a partial side profile view of a hammer in accordance with yet another embodiment of the present invention.

FIG. 8 is a partial side profile view of a hammer 210 in accordance with still another embodiment of the present invention that is substantially similar to hammer 110 of FIG. 7. In this regard, the hammer 210 includes a head 212 that is attached to a first end of handle 214 having a handle grip 216 (only partially shown). The head 212 of the hammer 210 includes a striking head 220 with a striking surface 222, and a conventional claw 224.

The hammer 210 also includes an interface section 230 that diagonally spans between the underside of the striking head 220 and the front side of the handle 214 and having an opening 231. Like the previously described embodiment, interface section 230 is provided with first, second, and third frontal extractors 232, 234, and 236, respectively, that may be used in the previously described manner to extract nails or other fasteners from a surface. The frontal extractors 232, 234, and 236 are formed on the interface section 230 by slots 233, 235, and 237, respectively, surface 238 defining a contact surface of a groove that extends through the slots.

As shown by the illustration of FIG. 8, the first slot 233 and the second slot 235 of hammer 210 are enlarged in the present embodiment and substantially angular in shape so that width of the slots decreases toward the interface section. This enlargement of the slots 233 and 235 allows easier placement of the head of the nail into the slots 233 and 235 as compared to the slots of the previously described embodiments, and thus, facilitates engagement of the head of the nail by the first frontal extractor 232 or the second frontal extractor 234. In particular, the angular shape of the slots 233 and 235 allows the user of the hammer 210 to readily engage a nail head by positioning the hammer 210 so that the slot corresponding to the desired frontal extractor is proximate to the head of the nail to be extracted, and then by pulling on the hammer 210 so that the head of the nail slides along the angled surface of the slot to be engaged by the extractor associated therewith. In such a manner, rapid extraction of nails is facilitated so that work efficiency can be further improved.

Of course, whereas FIGS. 1 to 8 discussed above illustrate embodiments of the present invention with three frontal extractors, other embodiments of the present invention may be provided with different numbers of extractors. As also previously noted and as shown in these illustrated embodiments, the interface section may be attached to the striking head and the handle. In other embodiments of the present invention as specifically described below, however, the interface section may be cantilevered so that it is attached to the striking head or the handle.

Figure 9:
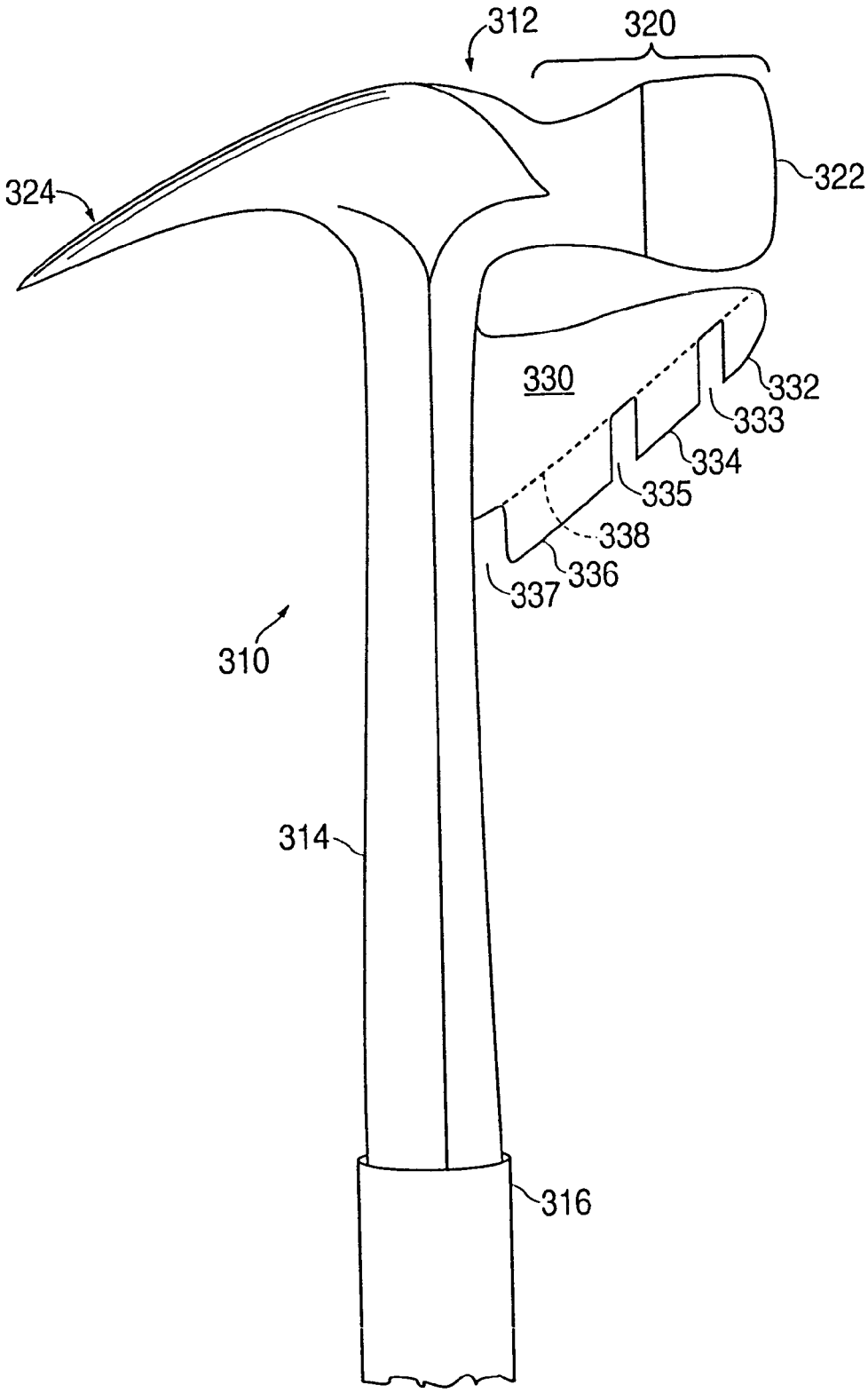
FIG. 9 is a partial side profile view of a hammer in accordance with still another embodiment of the present invention.

FIG. 9 is a partial side profile view of a hammer 310 in accordance with still another embodiment of the present invention. As shown, the hammer 310 includes a head 312 that is attached to a first end of handle 314 having a handle grip 316 (only partially shown). The head 312 of the hammer 310 includes a striking head 320 with a striking surface 322, and a conventional claw 324. The hammer 310 also includes an interface section 330 having first, second, and third frontal extractors 332, 334, and 336, respectively, that may be used in the previously described manner to extract nails or other fasteners from a surface. In this regard, the frontal extractors 332, 334, and 336 are formed on the interface section 330 by slots 333, 335, and 337, respectively, surface 338 defining a contact surface of a groove that extends through the slots.

In contrast with the previously described embodiments, the interface section 330 of hammer 310 is cantilevered and attached to the handle 314 of the hammer 310. The illustrated embodiment allows the interface section 330 and the frontal extractors provided thereon to be formed together with the handle 314 of the hammer 310. This may be especially advantageous in implementations where the hammer head is formed as a separate piece from the handle and then is attached together to provide a complete hammer. Again, it should be noted that whereas three frontal extractors are illustrated in the present embodiment, other embodiments may be provided with different number of extractors.

Figure 11:
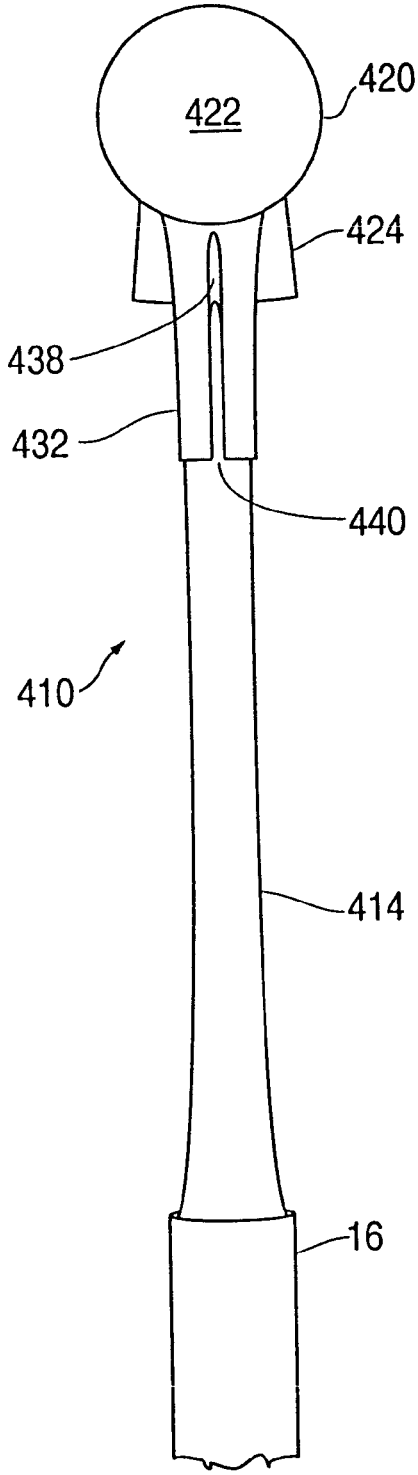
FIG. 11 is a frontal view of the hammer of FIG. 10.
Figure 10:
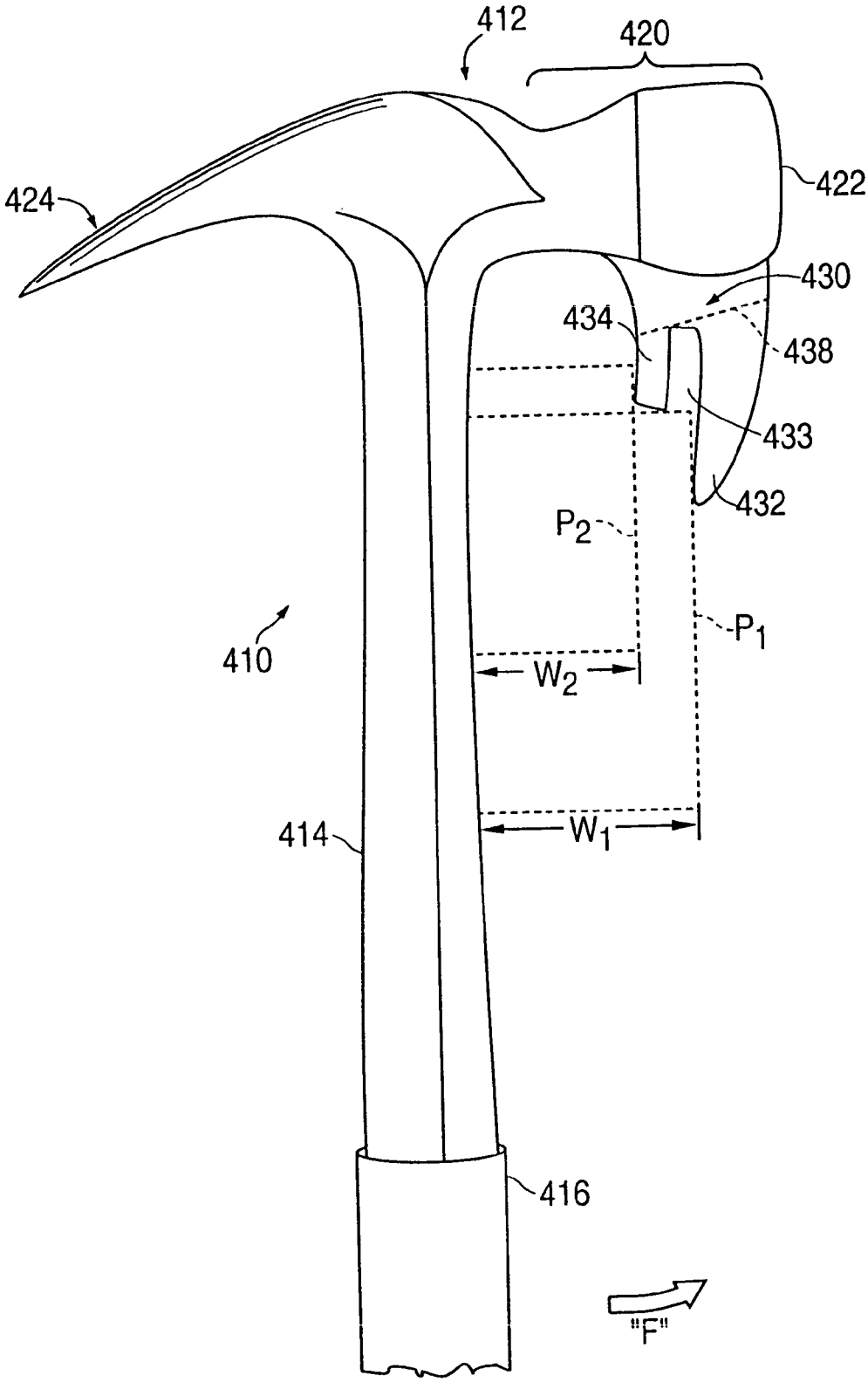
FIG. 10 is a partial side profile view of a hammer in accordance with yet another embodiment of the present invention.

FIG. 10 is a partial side profile view of a hammer 410 in accordance with yet another embodiment of the present invention, FIG. 11 showing a frontal view thereof. Like conventional claw hammers, the hammer 410 includes a head 412 that is attached to a first end of handle 414, the handle 414 being provided with handle grip 416 (only partially shown). The head 412 of the hammer 410 includes a striking head 420, and a conventional claw 424, the striking head extending perpendicularly from the handle 414 and having a striking surface 422.

In addition, the hammer 410 is provided with an interface section 430 that is attached to the striking head 420. In contrast to the previous embodiments described above with respect to FIGS. 1 to 9, the interface section 430 of hammer 410 is cantilevered from the striking head 420 and is not attached to the handle 414. The interface section 430 is provided with first and second frontal extractors 432 and 434, respectively. The first frontal extractor 432 is formed on the interface section 430 by slot 433, which is sized to allow the heads of nails or other fasteners to be engaged for the purpose of extraction. The second frontal extractor 434 is also formed on the interface section 430. Surface 438 (indicated by dashed line) in the interface section 430 defines a contact surface of a groove 440 shown in FIG. 11 that extends through the first frontal extractor 432 and second frontal extractor 434 and restricts movement of the nail or other fastener as it is extracted.

Figure 12:
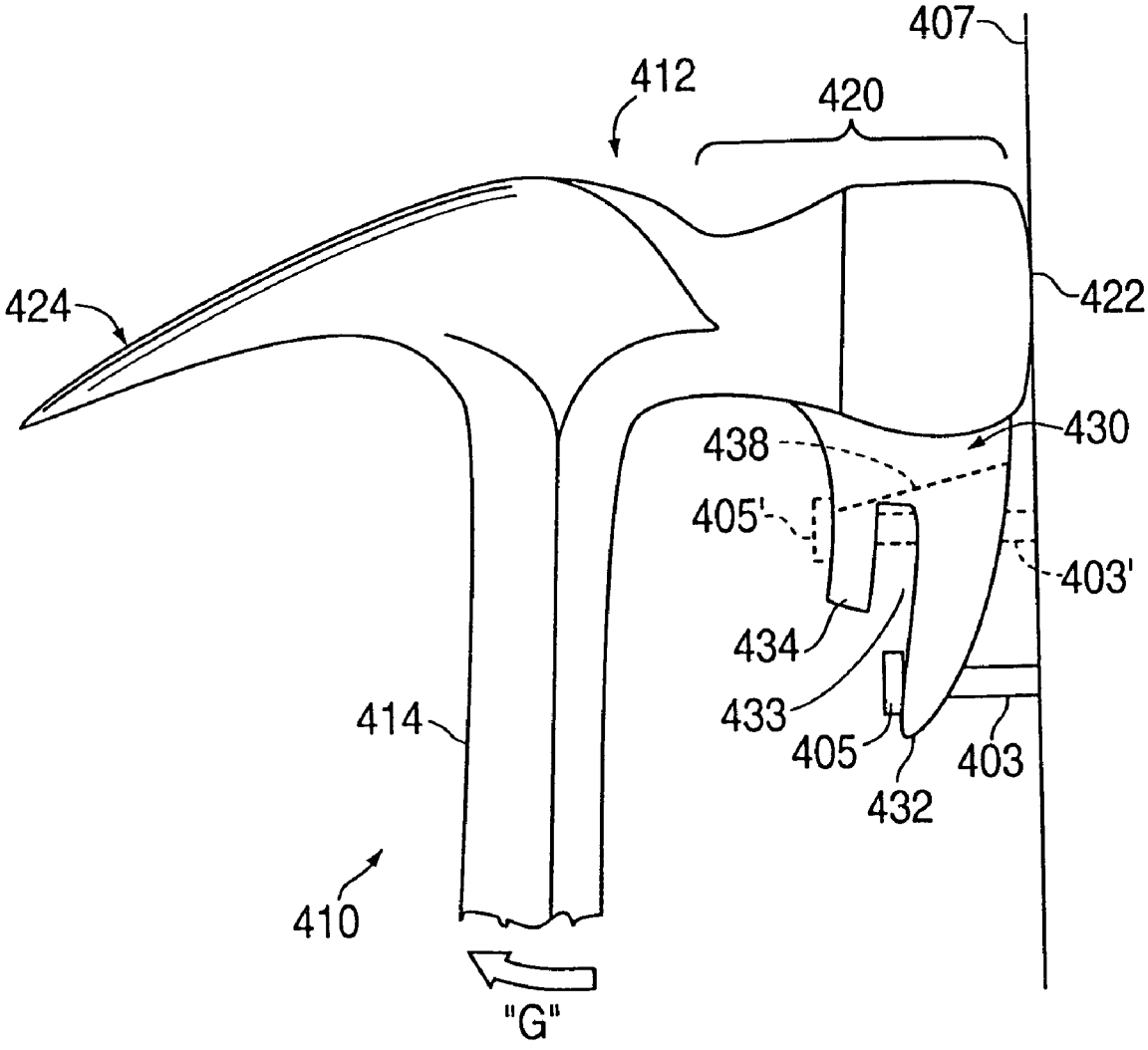
FIG. 12 is a side profile view of the hammer of FIG. 10 being used to extract a nail on a vertical surface using the frontal extractors.

FIG. 12 is a side profile view of the hammer of FIG. 10 being used to extract nail 403 from vertical surface 407 using the frontal extractors of the hammer 410. In particular, as shown, the head 405 of the nail 403 is engaged by the first frontal extractor 432 so that upon rotation of the hammer 410 in the direction of arrow "G", the nail 403 is pulled out from the surface 407. If the nail protrudes farther from the surface 407, or can be only partially removed using the first frontal extractor 432, then the second frontal extractor 434 may be used. For instance, the nail 403' that protrudes out farther from the surface 407 may be readily removed by engaging the second frontal extractor 434 to the nail head 405' as shown, and then, by rotating the hammer 410 in the direction of arrow G.

Referring again to FIG. 10, in the illustrated embodiment of the present invention, the first frontal extractor 432 and the second frontal extractor 434 both extend outwardly and are substantially parallel to the handle 414 of the hammer 410. In the preferred embodiment, the second frontal extractor 434 does not extend as far as the first frontal extractor 432, as shown. This allows the hammer 410 to be advantageously used to twist wood beams used in framing and carpentry by engaging such beams between the handle 414 of the hammer 410, and one of the frontal extractors 432 and 434.

In particular, as shown in FIG. 10, the hammer 410 and the first frontal extractor 432 provided thereon may be dimensioned to engage a wood beam schematically shown by dashed rectangle marked $P_1$ having a width dimension of $w_1$. By rotating the hammer 410 in the direction of arrow "F", the schematically illustrated wood beam $P_1$ may be readily rotated by the twisting action of the first frontal extractor 432 and the handle 414 of the hammer 410. Similarly, the second frontal extractor 434 may be dimensioned to engage a wood beam schematically shown by dashed rectangle marked $P_2$ having a width dimension of $w_2$ that is smaller than $w_1$. Again, by rotating the hammer 410 in the direction of arrow "F", the schematically illustrated wood beam $P_2$ may be readily rotated by the twisting action of the second frontal extractor 434 and the handle 414 of the hammer 410.

In the above regard, the handle 414 of the hammer 410 and the first frontal extractor 432 may be spaced approximately 1⅝ inches from each other to allow engagement and twisting of conventional "two by four" wood beams. The handle 414 of the hammer 410 and the second frontal extractor 434 may be spaced approximately 1¼ inches from each other to allow engagement and twisting of commonly used wood beams. Of course, it should be noted that the above described dimensions are merely provided as examples that add further utility and value to the hammer 410 as compared to conventional hammers.

It should be noted that whereas two frontal extractors 432 and 434 are shown with respect to the embodiment of FIG. 10 to 12, other embodiments of the present invention may be provided with different numbers of frontal extractors such as one frontal extractor or more than two frontal extractors. Furthermore, the frontal extractors may be of different or same lengths, and may be oriented parallel (as shown), or at an angle to the handle 414. The hammer 410 may be manufactured in any conventional manner. In this regard, the interface section 430 and the frontal extractors 432 and 434 may be integrally formed with the hammer head 412. Alternatively, the interface section 430 and the frontal extractors 432 and 434 may be manufactured separately from the hammer 410, and subsequently attached to the hammer head 412 by welding or by other manner or mechanism for secure attachment.

Moreover, although the frontal extractors of FIG. 10 to 12 are shown and described as protruding from interface section 430, which has a substantial thickness dimension, it should be noted that in the present embodiment, the interface section serves to secure the frontal extractors 432 and 434 to the underside of the striking head 420. Consequently, in other embodiments, the interface section 430 may be very thin or otherwise omitted so that the frontal extractors 432 and/or 434 essentially protrude out directly from the striking head 420 itself. The provision of the interface section 430, however, is preferred to control the bending of the nail during its extraction, and to allow extraction of long nails that would otherwise be difficult if the extractors were located closer to the striking head 420.

Figure 13:
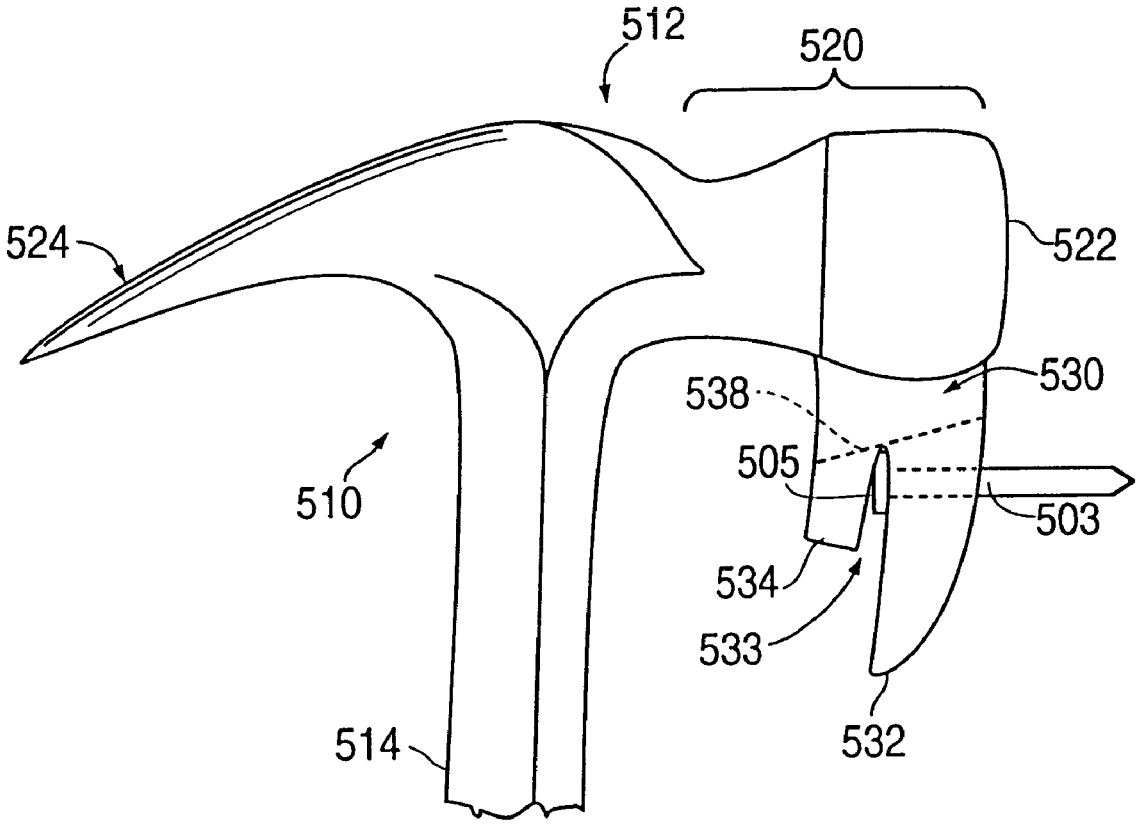
FIG. 13 is partial side profile view of a hammer in accordance with still another embodiment of the present invention.

FIG. 13 is a partial side profile view of a hammer 510 in accordance with still another embodiment of the present invention. As can be seen, the hammer 510 is like the hammer 410 described above with respect to FIGS. 10 to 12. The hammer 510 includes a head 512 that is attached to a first end of handle 514, the head 512 of the hammer 510 including a striking head 520 that extends substantially perpendicular to the handle 514, and a conventional claw 524, the striking head 520 including a striking surface 522. In addition, the hammer 510 is provided with an interface section 530 that is provided with first and second frontal extractors 532 and 534, respectively, and surface 538 (indicated by dashed line) that defines a contact surface of a groove that extends through the first and second frontal extractors 532 and 534, and restricts movement of the nail or other fastener as it is extracted.

In the illustrated embodiment, the slot 533 that forms the first frontal extractor 532 on the interface section 530 is sized to engage the head 505 of the nail 503 to thereby support the nail 503 in a substantially cantilevered position shown in FIG. 13. This allows the nail 503 to be initially driven into a surface by merely swinging the hammer 510 so as to strike the surface with the point of the nail 503, without requiring the user to support or position the nail 503 against the surface using his/her hands. The user then simply disengages the nail from the slot 533, after which the user may continue to drive the nail into the surface by using the conventional application of the hammer 510 as a striking tool. The slot 533 may be dimensioned to be between 1/16 to 1/8 inch in width so as to allow engagement of heads of most commonly used nails. Preferably, the slot 533 is dimensioned to be approximately 3/32 inch in width and to taper down slightly in width toward the interface section 530 so as to allow engagement of nail heads of varying thicknesses.

Instead of the above method of retaining the nail 503 in the slot 533, or in addition thereto, the interface section 530, the first frontal extractor 532, and/or the second frontal extractor 534 may be magnetized so as to allow supporting of a nail in a substantially cantilevered position as shown. Since most nails and fasteners are made of steel, they can be supported in position by magnetic force thereon. Of course, this feature may also be readily incorporated into the embodiments of the present invention described above with respect to FIGS. 1 to 9 as well.

Figure 14:
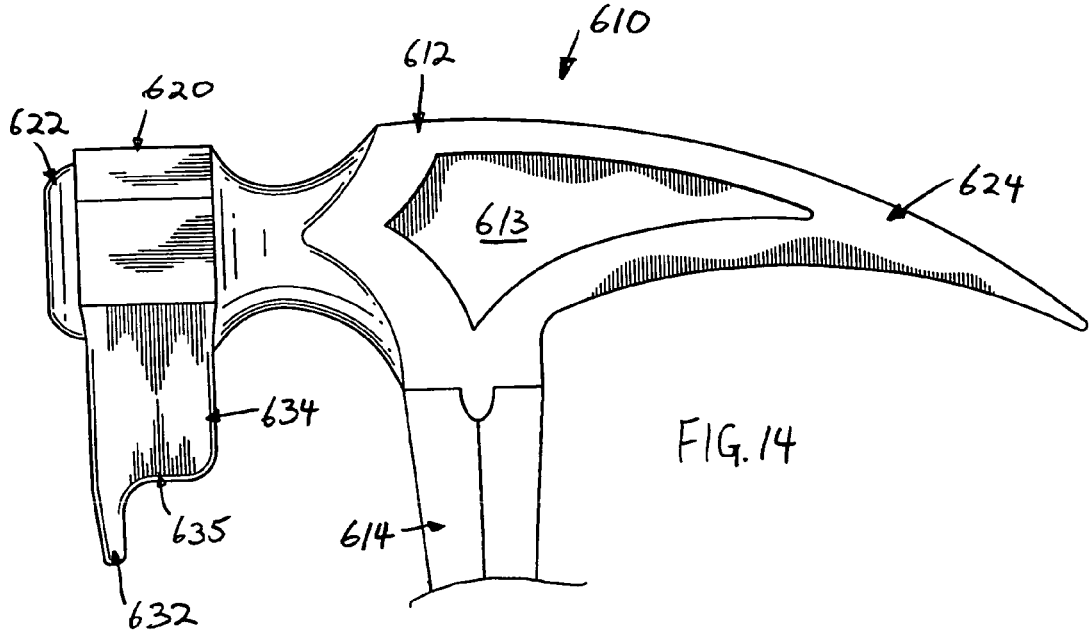
FIG. 14 is a partial side profile view of a hammer in accordance with yet another embodiment of the present invention.

FIG. 14 is a partial side profile view of a hammer 610 in accordance with yet another embodiment of the present invention. As can be seen, the hammer 610 is similar to the hammer 410 described above with respect to FIGS. 10 to 12. In this regard, the hammer 610 of the illustrated embodiment is provided with features that are substantially similar to the hammer 410. As described in further detail below, the primary distinction between the two embodiments is that the hammer 610 includes a webbing 635 that spans between the frontal extractors to cover the ends of the slot.

In particular, the hammer 610 includes a head 612 with a body 613 that is attached to a first end of handle 614, the head 612 extending substantially perpendicular to the handle 614. The head 612 of the hammer 610 includes the body 613, a striking head 620 positioned at one end of the head 612, and a conventional claw 624 at the opposing end. The striking head 620 includes a striking surface 622 positioned at the distal end thereof. In addition, as most clearly shown in the rear perspective view of FIG. 15 as well as the underside view of FIG. 16, the striking head 620 of hammer 610 is provided with a first frontal extractor 632 and a second frontal extractor 634. As shown in FIG. 14, the first and second frontal extractors are positioned toward the distal end of the striking head 620, proximate to the striking surface 622 of the striking head 620, and on the underside thereof.

Figure 16:
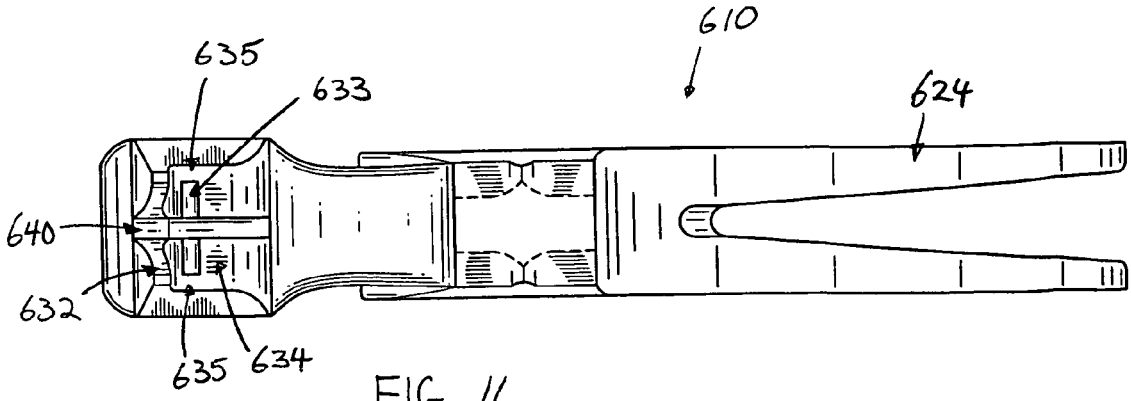
FIG. 16 is an underside view of the hammer of FIG. 14.

Referring to FIG. 16, a groove 640 extends through the first and second frontal extractors 632 and 634, so as to partially define the frontal extractors. In the manner previously described, the groove 640 restricts movement of the nail or other fastener as it is extracted using the frontal extractors. However, instead of a slot that extends across the transverse width of the extractors to clearly separate the first frontal extractors 632 from the second frontal extractors 634 as shown in the previously described embodiments, the slot in the present embodiment does not extend through the frontal extractors. Instead, the slot is surrounded at each end by a webbing 635 so that the first and second frontal extractors are connected by the webbing. Preferably, the webbing 635 is integrally formed together with the frontal extractors during manufacturing of the hammer head 612, and is not a discrete component of the hammer head 612. In this regard, the webbing 635 is preferably made of the same material as the hammer head 612 such as steel, and is formed together with the other physical features of the hammer head 612.

Figure 15:
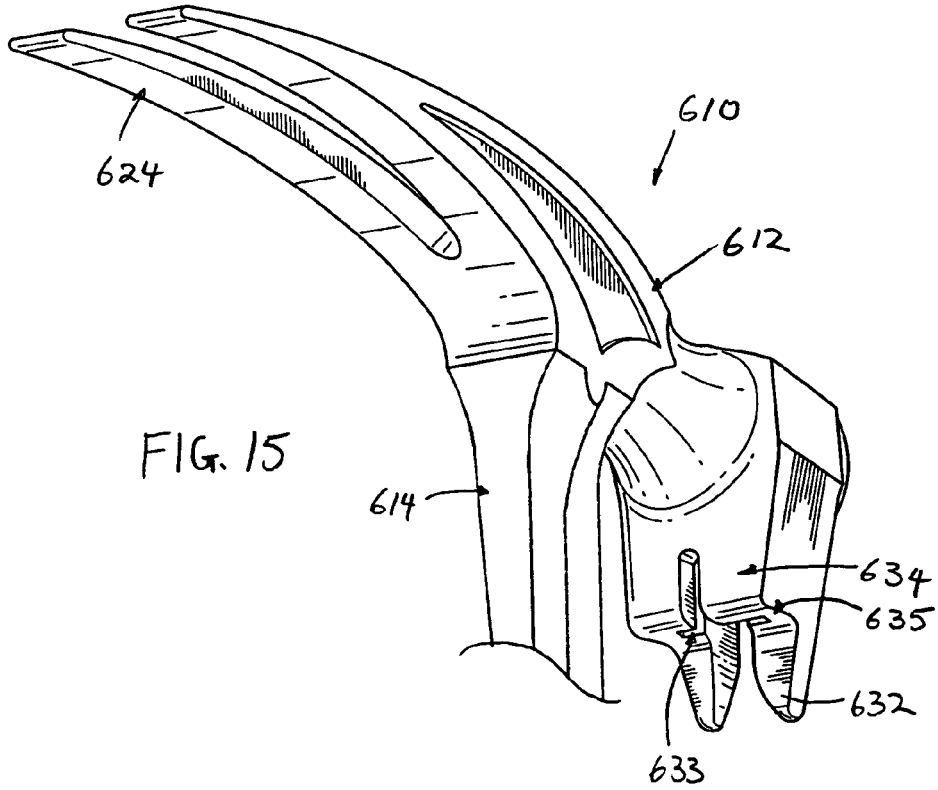
FIG. 15 is rear perspective view of the hammer of FIG. 14.

The webbing 635 is most clearly shown in the rear perspective view of FIG. 15 and the underside view of FIG. 16. The groove 640 extends in the longitudinal direction of the head 612 thereby defining the space between the frontal extractors in which the shank of the nail is received as the nail is extracted by the first frontal extractors 632 or the second frontal extractors 634. The slot 633 extends in the transverse direction of the head 612 in the manner most clearly shown in FIG. 16 to thereby define the first and second frontal extractors 632 and 634. In contrast to the previously described embodiments, the slot 633 does not extend the width of the frontal extractors. Instead, the first and second frontal extractors 632 and 634 are connected at the outer side peripheral edges by the webbing 635. Stated in another manner, the slot 633 is dimensioned smaller than the transverse width of the extractors such that the slot 633 is bounded by remaining material of the hammer head 612 that forms the webbing 635. Thus, as also clearly shown in FIG. 16, the intersection of the groove 640 and the slot 633 resembles a cross, especially due to the webbing 635.

Of course, the slot 633 is sufficiently sized in the transverse and longitudinal directions of the head 612 to receive a nail head therein during extraction. In this regard, the slot 633 may be dimensioned to be between 1/16 to 1/8 inch in width (in the longitudinal direction of the head 612) so as to allow engagement of heads of most commonly used nails. Preferably, the slot 633 is dimensioned to be approximately 3/32 inch in width so as to allow engagement of nail heads of varying thicknesses.

The hammer 610 is used in substantially the same manner as the hammer 410 discussed above. In this regard, the protruding nail head is initially engaged by sliding the nail head between the first frontal extractors 632 and into the slot 633 so that the first frontal extractors 632 is between the head of the nail and the wood surface in which the nail is embedded. Thus, the head of the nail is positioned close to the striking head 620 to increase leverage in comparison to prior art hammers. The handle of the hammer 610 is then rotated so that the head 612 pivots about the striking face 622 with the striking face 622 serving as the fulcrum point, thereby pivoting the frontal extractors upward and pulling on the nail head to extract the nail. The hammer 610 can then be disengage from the nail head, and repositioned with the shank of the partially extracted nail within the groove 640 so that the nail head is now engaged by the second frontal extractor 634. Rotating the handle of the hammer 610 again further extracts the nail by causing the second frontal extractors 634 to pull on the head of the nail.

The provision of the webbing region 635 between the first frontal extractors 632 and the second frontal extractors 634 has been found to significantly increase the extraction load capacity and durability of both the first and second frontal extractors. In particular; the webbing region 635 aids in distributing the load stresses exerted on the frontal extractors during the extraction process. For instance, if the first frontal extractors 632 are being used to extract the nail, the forces exerted on the first frontal extractors 632 are partially distributed to the second frontal extractors 634 through the webbing 635 that connects the first and second frontal extractors. Likewise, if the second frontal extractors 634 are being used to extract the nail, the forces exerted on the second frontal extractors 634 are partially distributed to the first frontal extractors 632 through the webbing 635. Correspondingly, a much higher force can be exerted to extract nails with minimal concern for the load stress bearing capacity of the frontal extractors. It should also be evident that the durability of both the first and second frontal extractors are also significantly increased since the stresses exerted on each of the frontal extractors are effectively reduced.

Figure 17:
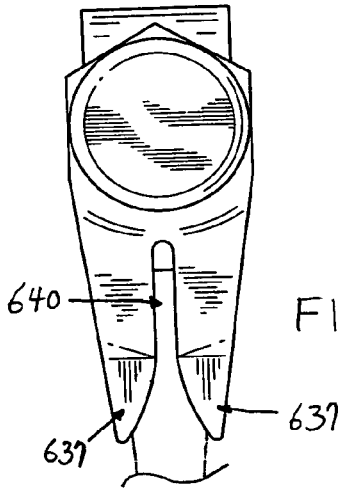
FIG. 17 is a frontal view of the hammer of FIG. 14.

Furthermore, as shown in the frontal view of FIG. 17, the illustrated embodiment of the first frontal extractors 632 of the hammer 610 are provided with angled tips 637 that increase the width of the groove 640 at the distal end of the first frontal extractors 632. The angling of the tips 637 of the first frontal extractors 632 facilitates positioning the shank of the nail between the first frontal extractors 632 and within the groove 640 when the hammer 610 is being used to extract a nail. As can be appreciated by examination of FIG. 17, in the illustrated preferred embodiment, the tips are angled with a curvature to thereby further facilitate smooth positioning of the shank of the nail between the first frontal extractors 632. Of course, in other embodiments, the tips 637 need not be angled or be provided with a curvature.

As previously noted, the hammer and hammer head in accordance with the present invention may be manufactured in any conventional manner using steel and/or other appropriate materials. The described interface section with the frontal extractors thereon may be integrally formed with the hammer head and/or the handle, or alternatively, be manufactured separately and subsequently attached by welding or by any other appropriate manner. This allows the interface section and the frontal extractors in accordance with the present invention to be implemented as a separate component that is retrofitted to existing conventional hammers.

While various embodiments in accordance with the present invention have been shown and described, it is understood that the invention is not limited thereto. The present invention may be changed, modified and further applied by those skilled in the art. In addition, as initially noted, the present invention may also be readily applied to hammer heads that are then assembled together with a handle to provide a complete hammer. Therefore, this invention is not limited to the detail shown and described previously, but also includes all such changes and modifications.

I claim:

1. A hammer comprising:

a handle with a first end and a second end;

a hammer head secured to said first end of said handle, said hammer head having a striking head extending from said handle, said striking head having a striking surface thereon;

a first frontal extractor disposed between said striking surface and said handle such that said striking surface is positioned further from said handle than said first frontal extractor; and a second frontal extractor disposed between said first frontal extractor and said handle;

wherein said first frontal extractor and said second frontal extractor extend from said striking head and at least one slot extending substantially parallel to said striking surface is positioned between said first and second frontal extractors with a webbing connecting said first and second frontal extractors together.

2. The hammer of claim 1, wherein said first frontal extractor extends from said striking head at a distal end thereof.

3. The hammer of claim 2, wherein said second frontal extractor extends from said striking head and is shorter in length than said first frontal extractor.

4. The hammer of claim 3, further including a groove that extends through said first and second frontal extractors.

5. The hammer of claim 3, wherein said second frontal extractor extends substantially parallel to said handle.

6. The hammer of claim 3, wherein said second frontal extractor is spaced approximately 1¼ inches from said handle.

7. The hammer of claim 2, wherein said first frontal extractor extends from said striking head substantially parallel to said handle.

8. The hammer of claim 2, wherein said first frontal extractor is spaced approximately 1⅝ inches from said handle.

9. The hammer of claim 1, wherein said at least one slot is sized to allow a head of a nail to be supported therein so that said nail is cantilevered substantially perpendicular relative to said striking surface.

10. The hammer of claim 1, wherein said at least one slot is dimensioned approximately between 1/16 to ⅛ inch in width.

11. The hammer of claim 10, wherein said slot is dimensioned approximately 3/32 inch in width.

12. The hammer of claim 1, wherein said at least one slot is bounded by said webbing at ends thereof.

13. The hammer of claim 12, wherein said webbing is integrally formed with said first and second frontal extractors.

14. The hammer of claim 1, wherein at least one of said first frontal extractor and said second frontal extractor is magnetized to allow a nail to be supported therein so that said nail is cantilevered substantially perpendicular relative to said striking surface.

15. The hammer of claim 1, wherein said first frontal extractor includes tips at a distal end thereof that are angled.

16. The hammer of claim 15, wherein said tips are angled with a curvature.

17. The hammer of claim 1, wherein said hammer head includes a conventional claw positioned opposite to said striking head.

18. A hammer head comprising:

a body;

a striking head extending from said body, said striking head having a striking surface thereon that defines a front of said hammer head;

a first frontal extractor disposed adjacent a distal end of said striking head proximate to said striking surface;

a second frontal extractor disposed between said first frontal extractor and a proximal end of said striking head; and at least one slot positioned between said first and second frontal extractors, said at least one slot extending substantially parallel to said striking surface;

wherein said at least one slot is bound by a webbing at ends thereof.

19. The hammer head of claim 18, wherein said first frontal extractor is longer than said second frontal extractor.

20. The hammer head of claim 18, wherein said first frontal extractor is substantially parallel to said striking surface.

21. The hammer head of claim 18, wherein said second frontal extractor is substantially parallel to said striking surface.

22. The hammer head of claim 18, further including a groove that extends through said first frontal extractor and said second frontal extractor.

23. The hammer head of claim 18, wherein said webbing connects said first frontal extractor and said second frontal extractor together.

24. The hammer head of claim 23, wherein said webbing is integrally formed with said first frontal extractor and said second frontal extractor.

25. The hammer head of claim 18, wherein said slot is sized to retain a head of a nail therein so that said nail is retained in said groove and cantilevered substantially perpendicular relative to said striking surface.

26. The hammer head of claim 25, wherein said slot is dimensioned approximately between 1/16 to 1/8 inch in width.

27. The hammer head of claim 18, wherein at least one of said first frontal extractor and said second frontal extractor is magnetized to allow a nail to be retained in said groove and cantilevered substantially perpendicular relative to said striking surface.

28. The hammer head of claim 18, wherein said first frontal extractor extends from said striking head and includes tips at a distal end thereof that are angled.

29. The hammer head of claim 28, wherein said tips are angled with a curvature.

30. The hammer head of claim 18, further comprising a conventional claw positioned opposite to said striking head.

31. The hammer head as defined in claim 18, further comprising a handle extending from said body.

32. A hammer head comprising:

a body;

a striking head extending from said body, said striking head having a striking surface thereon that defines a front of said hammer head;

first and a second frontal extractors disposed adjacent a distal end of said striking head proximate to said striking surface, said first and second frontal extractors having a transverse dimension; and at least one slot positioned between said first and second frontal extractors, said at least one slot having a transverse dimension less than the transverse dimension of said first and second frontal extractors.

33. The hammer head of claim 32, wherein said first frontal extractor is substantially parallel to said striking surface.

34. The hammer head of claim 32, wherein said second frontal extractor is substantially parallel to said striking surface.

35. The hammer head of claim 32, further including a groove extending through said first frontal extractor and said second frontal extractor.

36. The hammer head of claim 32, wherein at least one of said first frontal extractor and said second frontal extractor is magnetized to allow a nail to be retained in said slot and cantilevered substantially perpendicular relative to said striking surface.

37. The hammer head of claim 32, further comprising a conventional claw positioned opposite to said striking head.

38. The hammer head as defined in claim 32, further comprising a handle extending from said body.

* * * * *